United States Patent [19]

Henry

[11] 4,303,163

[45] Dec. 1, 1981

[54] COLLAPSIBLE DISPLAY RACK

[75] Inventor: Jack C. Henry, Downington, Pa.

[73] Assignee: Leon L. Berkowitz Co., Glenside, Pa.

[21] Appl. No.: 52,899

[22] Filed: Jun. 27, 1979

[51] Int. Cl.[3] ..... A47F 5/13

[52] U.S. Cl. ..... 211/133; 211/132; 211/181

[58] Field of Search ..... 211/133, 132, 181, 85, 211/195; 220/19; 248/159

[56] References Cited

U.S. PATENT DOCUMENTS

| | | | |
|---|---|---|---|
| 1,559,064 | 10/1925 | Bitney | 211/85 |
| 2,896,793 | 7/1959 | Bogart | 211/132 |
| 3,099,357 | 7/1963 | Harris | 211/133 |
| 3,244,128 | 4/1966 | Rogalski et al. | 211/133 X |
| 3,693,808 | 9/1972 | Rauch | 211/181 |
| 3,955,787 | 5/1976 | Brown | 248/159 |

FOREIGN PATENT DOCUMENTS

| | | | |
|---|---|---|---|
| 2344662 | 3/1976 | France | 211/181 |

*Primary Examiner*—Roy D. Frazier
*Assistant Examiner*—Robert W. Gibson, Jr.
*Attorney, Agent, or Firm*—Caesar, Rivise, Bernstein & Cohen, Ltd.

[57] ABSTRACT

A collapsible display rack having a collapsible bin as its primary novel feature. The bin comprises a base having a plurality of frame members pivotally mounted thereon. The frame members are pivotable from a collapsed, substantially horizontal position to a vertical position. The frame members are maintained in their vertical position by linking rods, with the rods, in combination with the tops of the frame members, forming a loop. A flexible receptacle is then placed within the vertical frame members, and the receptacle is filled with various commodities that are to be vended.

15 Claims, 6 Drawing Figures

FIG. 4
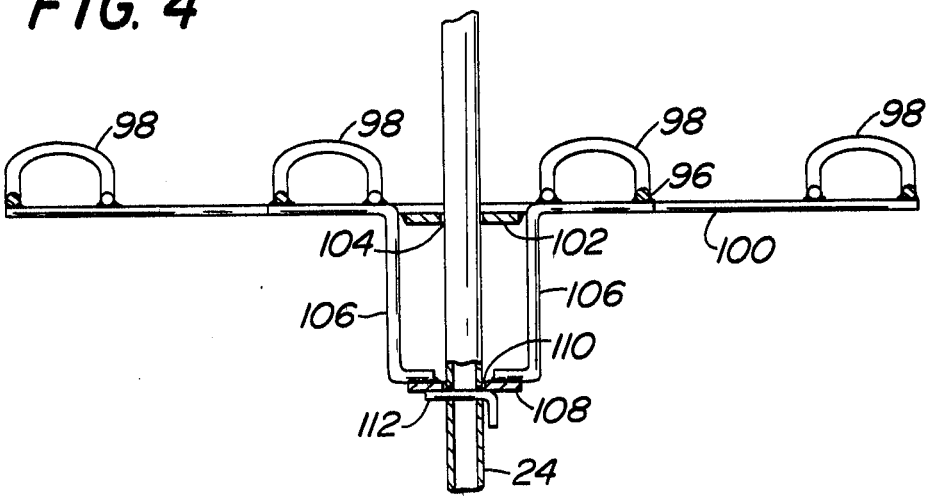
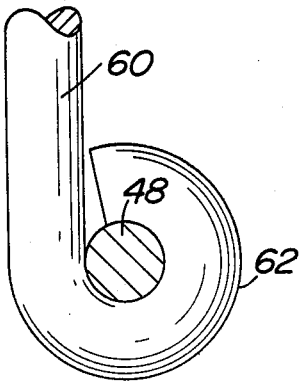
FIG. 5
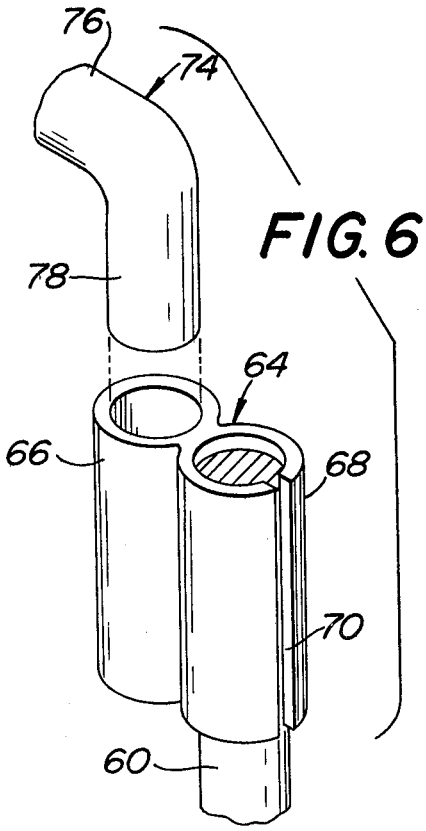
FIG. 6

COLLAPSIBLE DISPLAY RACK

This invention relates to a collapsible display rack, and more particularly, to a collapsible display rack that has as its primary novel feature a collapsible bin for storing and displaying small commodities to be vended.

It is now a common practice in consumer merchandising to display individual types of commodities or related commodities on single, free-standing display racks. The display racks can be set up in any available location within a store, and can easily be taken down when they are no longer necessary. Stores will use such racks for displaying all of the related goods of a single manufacturer or for displaying specially priced sale items, which are to be sold from a prominent and highly visible location. Such racks have been used for selling such various commodities as stockings, panty hose, batteries, balls, small toys, tooth brushes, etc.

Since these racks are not usually permanent fixtures in a store, a desired property of the racks is that they be easily assembled and disassembled. However, at the same time, they should be durable enough to withstand continued use and long periods of use. A further desired feature of the racks is that they be extremely compact when disassembled so that they can be easily stored in a small space. At the same time the racks should be constructed in such a way that they can easily be reassembled when it is desired to use them, and that the assembly be capable of being carried out with a minimum of tools and skill.

The rack of this invention enjoys all of the aforementioned features. It is easily assembled and disassembled, and can be assembled with a minimum of tools and skill. It is extremely durable, and can withstand long periods of use without any deleterious effects. The rack is extremely attractive, and provides total visibility to the goods that are being vended thereon. When the rack is packed for storage, it will fit in a box which is only four inches (10.2 cm) high. This facilitates both storage and shipment of the rack.

There have been various collapsible racks that have been used in the past. However, the rack of this invention has a number of unique features, as compared to these prior racks, which makes the instant rack highly desirable. The cost of manufacture is extremely low, as compared to many of the these prior racks, and it is easier to manufacture and assemble. Furthermore, the rack of this invention is as durable as the more complicated and expensive racks.

It is accordingly an object of this invention to provide a novel collapsible display rack.

It is another object of this invention to provide a collapsible display rack having as its primary feature a novel collapsible display bin.

It is a further object of this invention to provide a novel collapsible display bin that can be used in a self-supporting manner.

These and other objects of this invention are accomplished by providing a collapsible display bin comprising a base, a plurality of frame members pivotally mounted on said base, said frame members being pivotable to a vertical position, and spaced from one another, means linking said frame members at their tops to form a loop with said tops and to maintain said frame members in said vertical position, and a flexible receptacle supported by said loop.

Other objects and many of the attendant advantages of this invention will be readily appreciated as the same becomes better understood by reference to the following detailed description when considered in connection with the accompanying drawings wherein:

FIG. 4 is an enlarged sectional view taken along the line 4—4 of FIG. 1;

FIG. 5 is a partial sectional view showing the pivotal securement of one leg of a frame member to the base of the display bin; and, FIG. 6 is a partial perspective view showing the connection between a linking member and the top of a frame member of the display bin.

Figure 1:
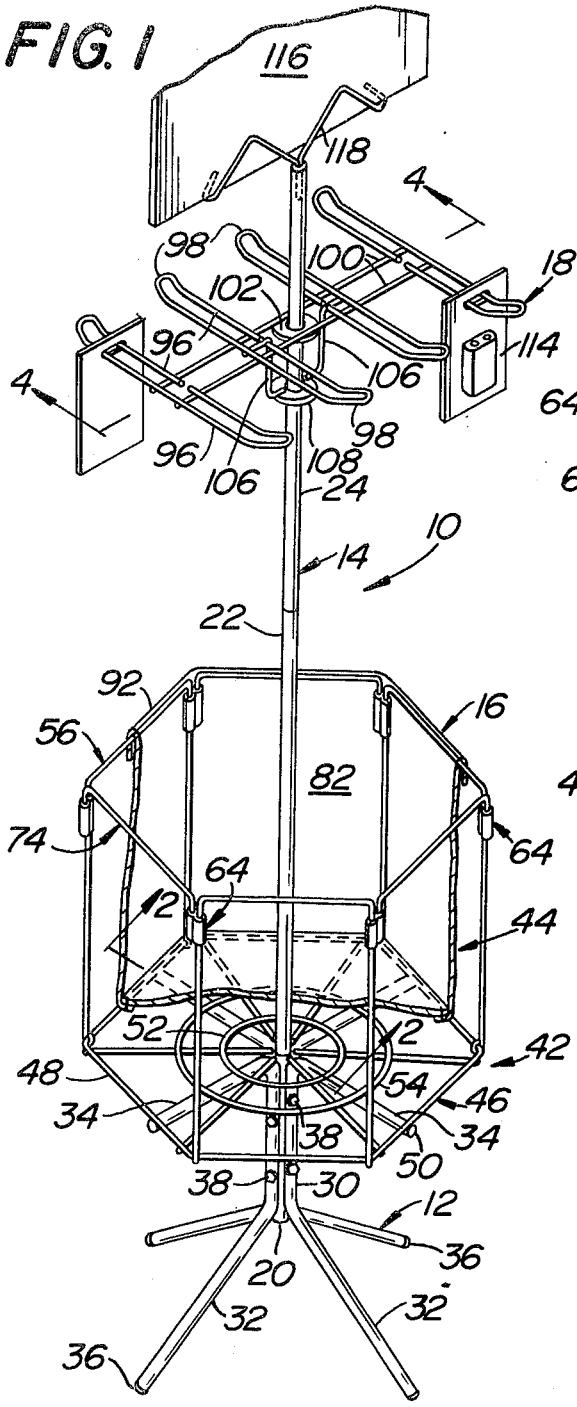
FIG. 1 is a perspective view of the collapsible display rack of this invention.

Referring now in greater detail to the various figures of the drawings wherein like reference characters refer to like parts, a collapsible display bin embodying the present invention is generally shown at 10 in FIG. 1. Device 10 basically comprises a plurality of supporting legs 12, a center post 14, a display bin 16 and an upper rack 18.

Figure 2:
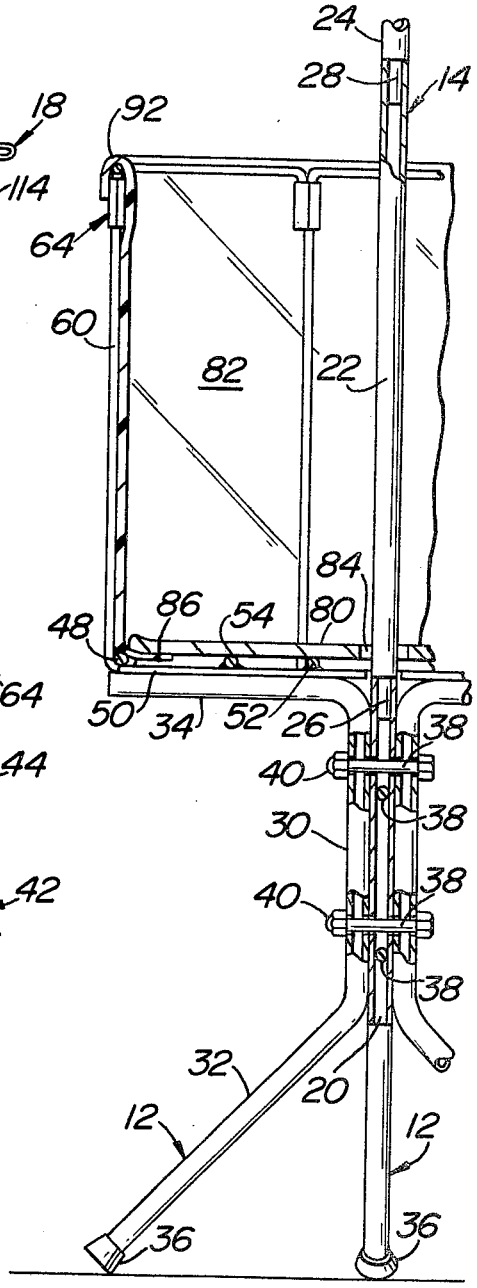
FIG. 2 is an enlarged sectional view taken along the line 2—2 of FIG. 1.

As seen in FIG. 2, center post 14 comprises a lower tube 20, an intermediate tube 22 and an upper tube 24. A rod 26 is secured in the bottom of tube 22 and a rod 28 is secured in the bottom of tube 24. Rod 26 is inserted in the top of tube 20 and rod 28 is inserted in the topd of tube 22. In this way, the various tubes can be separated, and can be re-formed into the single post 14 by merely inserting the rods 26 and 28 into the next-lower tube, in which the rods are frictionally held. When so inserted, as seen in FIG. 2, the integral vertical post 14 is formed. When it is desired to collapse the rack, the three tubes are easily separated by lifting them vertically.

As best seen in FIG. 2, each leg 12 comprises a vertical section 30, an inclined lower section 32 and a horizontal upper section 34. Legs 12 are formed from tubular metal. The bottoms of the legs are conveniently covered by rubber end caps 36 in order to avoid marring the surface on which the rack is placed.

In assembly of the display rack, the legs 12 are equally spaced around the lower tube 20 of post 14. The legs are secured on the post by spaced pairs of bolts 38 and associated cap nuts 40.

Here again, when it is desired to collapse the rack, the nuts 40 are removed from their associated bolts, and the bolts 38 are then removed. This separates the legs 12 from the tube 20, and the legs can then be packed for storage. Alternatively, when it is desired to assemble the rack, the legs 12 are placed in the positions shown in FIGS. 1 and 2 and the bolts 38 are inserted in preformed holes in the legs and tube 20.

Figure 3:
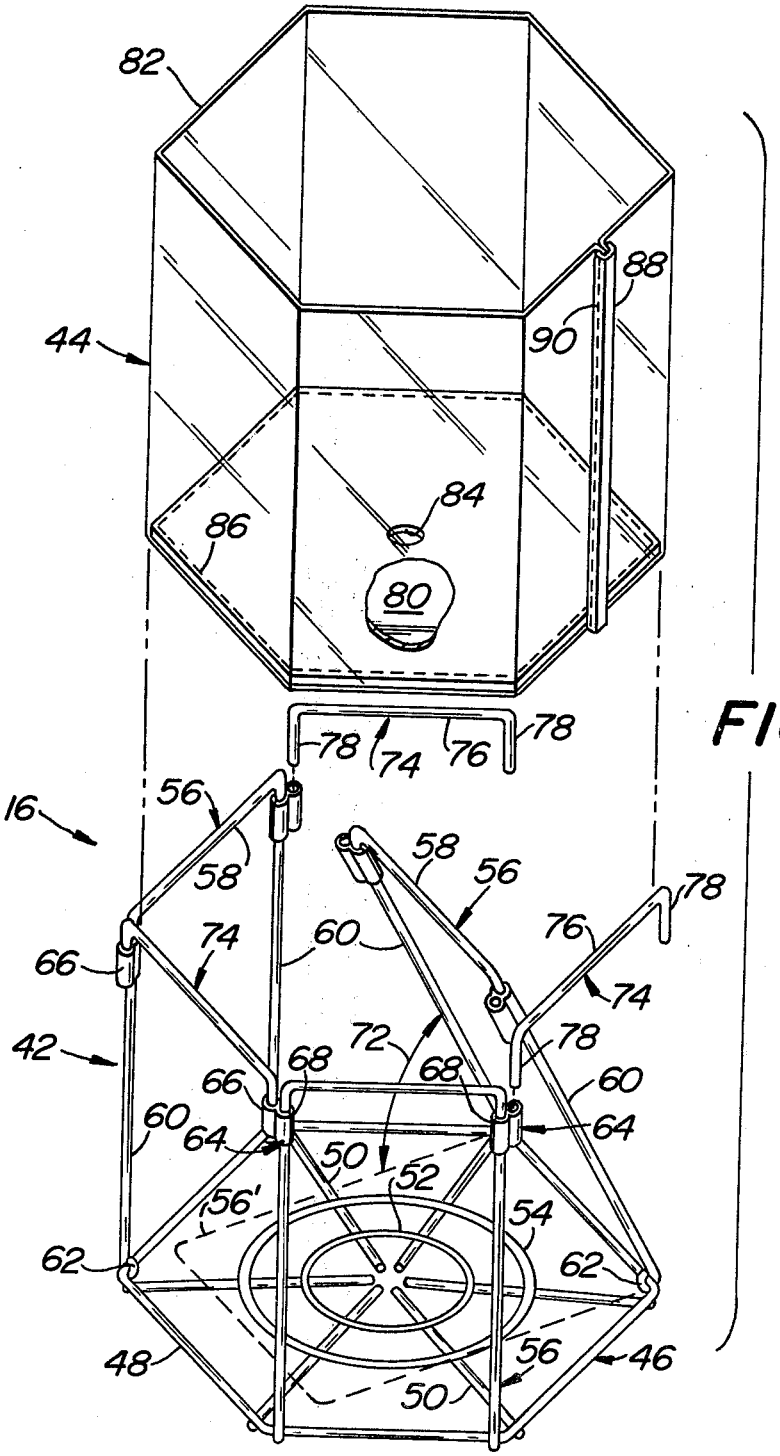
FIG. 3 is an exploded perspective view of the elements comprising the display bin of this invention.

After the legs 12 and the center post 14 are assembled, the display bin 16 is slid over the post 14, into the position shown in FIGS. 1 and 2. In order to facilitate the placing of the bin 16 on the post, the upper tube 24 is not placed on tube 22 until after the bin 16 has been put into the position shown in FIGS. 1 and 2. As seen in FIG. 3, the bin 16 basically comprises a frame 42 and a flexible receptacle 44 that is inserted within the frame.

Referring still to FIG. 3, it is seen that the frame 42 includes a base 46. Base 46 includes an outer wire loop 48 and a plurality of radially extending ribs 50 which are welded at their ends to the underside of the wire loop 48. The inner ends of ribs 50 form a round opening at the center of the base 46. The ribs 50 are held in their configuration by concentric rings 52 and 54 welded to the top sides of the ribs. In the embodiment shown, the loop 48 is formed in the shape of hexagon.

Three, equally-spaced U-shaped frame members 56 project upwardly from base 46. The frame members are on alternate legs of the hexagon forming the loop 48. Each frame member 56 includes a horizontal portions 58 and dependent legs 60. The bottom of each leg 60 is formed into a loop 62, whereby each frame member 56 is rotatably mounted about base loop 48. This mounting is best seen in FIG. 5.

As best seen in FIG. 6, a bracket 64 is secured on each leg 60 at the top thereof. Bracket 64 comprises a pair of aligned and joined sleeves 66 and 68. Each sleeve 68 includes a vertical slot 70.

As the frame members 56 are being bent from wire rods, prior to the formation of loop 62, a bracket 64 is slid upwardly on each leg 60, with the sleeve 68 being positioned on the leg. Once the bracket 64 is in the position shown in FIG. 3, the sleeve 68 is crimped, thereby compressing it at slot 70, and frictionally engaging the sleeve on the leg, thereby rigidly holding the bracket 64 in place.

During the shipping and storage of the display rack of this invention, the frame members 56 are in a substantially horizontal position, overlying the base 46. Thus, as indicated by the arrow 72 in FIG. 3, each frame member 56 is pivotable around loop 48, from a vertical position to the substantially horizontal position shown at 56' in FIG. 3. Although only one frame member 56 has been shown as having been pivoted, obviously, the other two frame members can be pivoted in a like manner.

When the frame 42 is to be erected for use, the frame members 56 are rotated upwardly to the vertical positions shown in FIG. 3. They are maintained in these positions by support bars 74. Each support bar 74 comprises a horizontal section 76 and dependent outer lips 78.

In use, after the frame members 56 have been rotated to a vertical position, a support bar 74 is used to link a pair or adjacent frame members 56. A lip 78 of a support bar is placed in a sleeve 66 of one frame member and the other lip 78 is placed in the sleeve 66 of an adjacent frame member, in the manner shown in FIG. 6.

After all of the support bars 74 have been so inserted, the frame 42 is a rigid structure. The upper portion of the frame forms a substantially continuous loop, which is of the same configuration and size as the base loop 48. After the frame 42 has been erected, the receptacle 44 is inserted into the frame.

In the embodiment of the invention shown, the receptacle 44 comprises a rigid base 80 and a transparent, flexible wall 82. The base 80 can be formed from any rigid material. However, for the sake of economy and ease of manufacture, the base is formed from corrugated cardboard. A central opening 84 is formed in base 80.

The wall 82 is formed from a transparent, flexible plastic film. The film comprises any durable transparent plastic. Polyvinyl chloride is preferred, although polyethylene can also be used. The film preferably has a thickness of eight to ten mils (0.203 to 0.254 mm).

The plastic is originally in sheet form, and the bottom edge of the plastic is secured to the base 80, as by stitching 86. The wall 82 is closed by a strip 88 of the plastic film which is stitched in place, as shown at 90. Although the film 82 is shown in an upright condition in FIG. 3, it should be understood that because of the inherent flexible nature of the film it would not remain upright in an unsupported position. Accordingly, the film can be pushed against the base 80 for the storage and shipping of the display rack.

When the display rack is to be erected, the receptacle 44 is placed inside the frame 42. The base 80 is hexagonal in shape, and is slightly smaller in dimension than the base 48 of the frame 42. Accordingly, the receptacle 44 will easily fit within the frame, and will follow the contour of the frame.

After the receptacle 44 has been so inserted, the upper edge of the plastic wall 48 is folded over the loop formed by frame members 46 and support bars 74. Because the dimensions of the wall 48 are slightly less than the dimensions of the rigid loop formed by the upper portion of the frame, the plastic must be stretched to be folded over the upper loop. Because of the plastic memory of the plastic wall, the stretching of the film securely holds the receptacle 44 within and on the frame 42. The loop is shown at 92 in FIGS. 1 and 2.

Once the bin 16 has been placed on post 14, lateral movement is prevented by the opening formed by the confluence of ribs 50 and the opening 84 in base 80. The horizontal portions 34 of legs 12 vertically support the bin 16.

When it is desired to collapse the bin, the bin is removed from the post 14 by sliding it upwardly, and removing it from the post. Thereafter, the loop 92 on the wall 82 is unfolded, and the receptacle 44 is collapsed by compressing the film 82. Thereafter, support bars 74 are removed, and the frame members 56 are pivoted inwardly, as shown by arrow 72 in FIG. 3. In this way, the entire bin can be collapsed for storage.

A bracket 18 (FIG. 1) is mounted on the upper section 24 of post 14. As seen in FIG. 1, bracket 18 includes a plurality of spaced, parallel wire hanger bars 96 having upturned ends 98. The wire rods 96 are welded to transverse, parallel wire rods 100. As seen in FIG. 4, rods 100 are welded to a central disc 102, which has an opening 104 in the middle thereof. A pair of bent wire rods 106 have their lower ends welded to a second disc 108, which has a central opening 110 therein. Discs 102 and 108 are coaxial, and vertically spaced.

The upper ends of rods 106 are welded to the bottoms of the pair of wire rods 96 which bridge disc 102. The series of welds described above forms the wire rods and discs into a unitary bracket 18. In use, the bracket 18 is slid over the upper section 24 of post 14. Its vertical position on the post is maintained by a pin 112 (FIG. 4) that passes through the section 24, and supports the lower disc 108.

The rack 18 is used to support commodities that would normally be sold at the same time as the commodities placed in display bin 16. By way of example, if the display bin 16 is used to sell C-cell or D-cell batteries, the rack 18 can be used to sell 9-volt batteries. In FIG. 1, 9-volt batteries are shown as being suspended from rack 18 by a blister package 114.

Obviously, other combinations of vendable merchandise can be used with the rack of this invention. By way of further example, D-cell batteries can be suspended from rack 18, and flashlights can be placed in the bin 16.

Various other types of racks can be placed at the top of the posts 14. These can be single rod hanger bars or small wire circular bins. The number of additional racks that can be placed on the post 14 can be varied to suit the needs of the user.

In the embodiment of the invention shown, a display board 116 is mounted at the top post 14. Display board 116 can have any information desired thereon, such as the trademark of the company selling the products on the rack, general attention-getting advertising or a generic description of the goods on the rack. The display board 116 can be held in place by any means known to the art, such as the springwire clip 118, which has its lower end frictionally held in the top of tube 24.

It is thus seen that the display rack of this invention provides an economical and attractive mechanism for displaying vendable merchandise. Each of the elements of the rack is readily collapsible for storage. Reassembly is easily carried out, with the only tool necessary being a wrench to tighten the four cap nuts 40.

The display bin 16 can be mounted on the post 14, as shown, or it can be placed on any other supporting structure. It is totally free-standing, and can therefore be placed on the floor, if desired. Although the display bin has been shown and described as having a hexagonal cross-section, it should be understood that this invention can be adapted to various other cross-sections for the display bin. Thus, the bin can be round, square, octagonal, etc. Whenever the cross section is changed, all of the elements of the display bin will have the same cross-section. Thus, if the bottom loop 48 is round, the loop formed by the upper elements 56 and 74 will also be round, with each segment being arcuate, and having a radius of curvature the same as the bottom loop 48. Additionally, the base 80 of the receptacle 44 will also be round. Similar changes can be made when utilizing other shapes for the bin 16.

The wall 82 of the receptacle 44 has been shown and described as being a transparent plastic. This is preferred from the standpoint of attractiveness, durability and visibility of the items being vended. However, the wall 82 can be formed from any of the other materials used for making collapsible bins, such as netting, cloth, etc. The wall can also be formed from a translucent plastic, if desired.

Without further elaboration, the foregoing will so fully illustrate my invention, that others may, by applying current or future knowledge, adopt the same for use under various conditions of service.

What is claimed as the invention is:

1. A collapsible display bin comprising a base, a plurality of frame members pivotally mounted on said base, said frame members being pivotable to a vertical position, and spaced from one another, means linking said frame members at their tops to form a loop with said tops and to maintain said frame members in said vertical position, each of said frame members having a pair of brackets secured at the top thereof, with one bracket of said pair being on one side of said frame member and the second bracket of each pair being on the other side of said frame member, said brackets being releasably connected to said linking means, and a flexible receptacle supported by said loop.

2. The display bin of claim 1 wherein the perimeter of said base and said loop are formed in a substantially regular geometric shape.

3. The display bin of claim 2 wherein said geometric shape is a hexagon.

4. The display bin of claim 1 wherein said frame members are equally spaced around said base.

5. The display bin of claim 1 wherein each of said frame members is basically U-shaped, with the legs of each U being pivotally mounted to said base, and the bridging section of each U being uppermost.

6. The display bin of claim 1 wherein each bracket includes a sleeve, and each linking means comprises a bar having dependent fingers at the end thereof, with said fingers being adapted to be received in a pair of adjacent sleeves on said frame members, thereby maintaining said frame members in said vertical position.

7. The display bin of claim 1 wherein said frame members are pivotable from a substantially horizontal position wherein they overlie said base to said vertical position.

8. The display bin of claim 1 wherein said flexible receptacle comprises a rigid base and a flexible wall projecting upwardly therefrom.

9. The display bin of claim 8 wherein the perimeter of said base has a geometric shape, and said rigid base of said flexible receptacle has the same shape as said perimeter.

10. The display bin of claim 1 wherein said flexible receptacle includes a wall formed from a transparent plastic.

11. The display bin of claim 10 wherein the upper portion of the wall of said flexible receptacle is folded over said loop, and is held in place by the elastic, plastic memory of said transparent plastic.

12. A collapsible display rack comprising a collapsible support and a collapsible display bin supported thereby, said collapsible display bin comprising a base, a plurality of frame members pivotally mounted on said base, said frame members being pivotable to a vertical position, and spaced from one another, means linking said frame members at their tops to form a loop with said tops and to maintain said frame members in said vertical position, each of said frame members having a pair of brackets secured at the top thereof, with one bracket of said pair being on one side of said frame member and the second bracket of each pair being on the other side of said frame member, said brackets being releasably connected to said linking means, and a flexible receptacle supported by said loop.

13. The display rack of claim 12 wherein said support comprises a vertical post and a plurality of legs releasably secured to said post, said legs supporting said display bin, and said post passing vertically upward through said display bin.

14. The display rack of claim 13 wherein said post comprises a plurality of separable members.

15. The display rack of claim 13 and further including at least one auxiliary rack supported by said post.

* * * * *